United States Patent [19]

Stephenson

[11] 4,135,272

[45] Jan. 23, 1979

[54] MOP CONNECTOR

[75] Inventor: Reginald M. Stephenson, Winnipeg, Canada

[73] Assignee: Atlas-Graham Industries Company Ltd., Winnipeg, Canada

[21] Appl. No.: 788,260

[22] Filed: Apr. 18, 1977

[51] Int. Cl.[2] ..... A47L 13/24

[52] U.S. Cl. ..... 15/147 R; 24/16 PB

[58] Field of Search ..... 15/147, 150, 151, 228, 15/229 R, 229 A; 24/16 PB, 30.5 P, 129 D

[56] References Cited

U.S. PATENT DOCUMENTS

| | | | |
|---|---|---|---|
| 971,519 | 10/1910 | Brannen | 24/30.5 P UX |
| 1,137,760 | 5/1915 | Kawasaki | 15/147 R UX |
| 3,187,363 | 6/1965 | Auwarter | 15/150 X |
| 3,246,356 | 4/1966 | Sorrells | 15/150 X |
| 3,457,581 | 7/1969 | Oas | 15/147 R |
| 3,672,003 | 6/1972 | Morgan | 24/16 PB |
| 3,713,184 | 1/1973 | Leland | 15/150 X |

FOREIGN PATENT DOCUMENTS

| | | | |
|---|---|---|---|
| 1231614 | 12/1966 | Fed. Rep. of Germany | 24/16 PB |
| 1200824 | 8/1970 | United Kingdom | 15/147 R |

*Primary Examiner*—Daniel Blum
*Attorney, Agent, or Firm*—Stanley G. Ade

[57] ABSTRACT

A connector receives the mop handle at one end thereof and the mop body of a string or yacht type mop in the other end. The connector includes a substantially dome-shaped other end and a flexible strap engages one side of the dome-shaped end, passes around the center of mop strands and is pulled tightly through an aperture in the other side of the dome-shaped end and is locked into position thus holding the mop head firmly into the dome-shaped end. Various locking projections are provided within the dome-shaped end and on the strap to prevent relative movement between the mop head and the dome-shaped end.

4 Claims, 9 Drawing Figures

FIG. 5
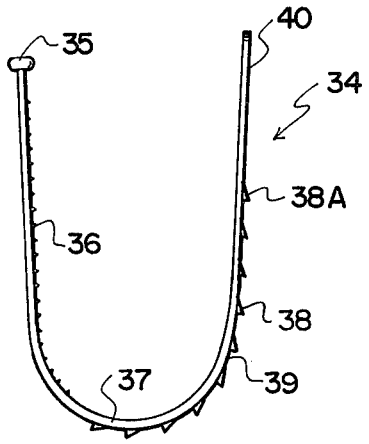
FIG. 6
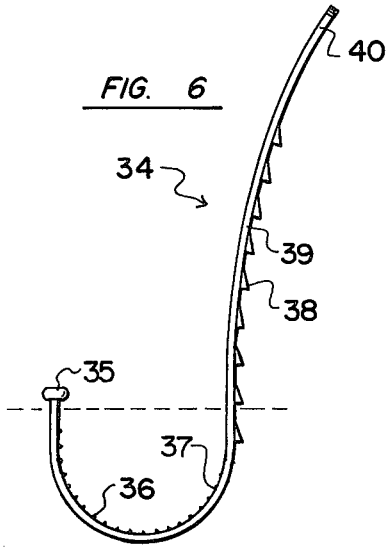
FIG. 7
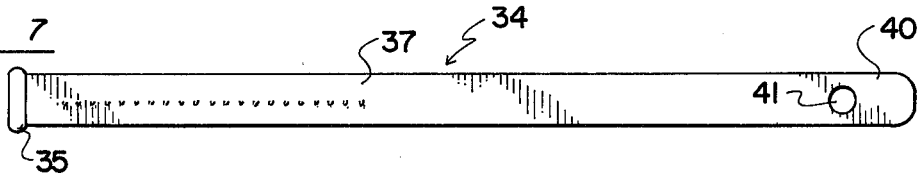
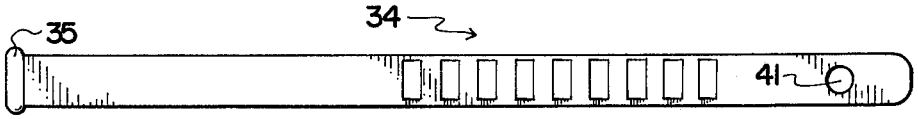
FIG. 8
FIG. 9
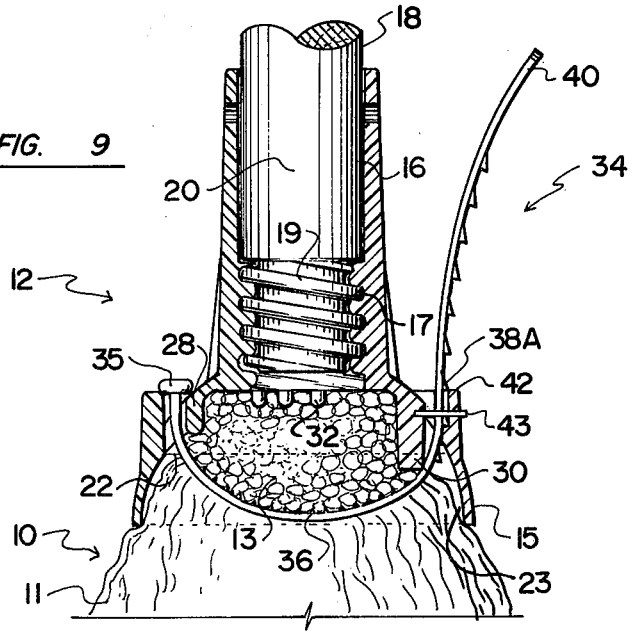

MOP CONNECTOR

BACKGROUND OF THE INVENTION

This invention relates to new and useful improvements in mop connectors, particularly connectors which are adapted to receive a handle on one side and a string type or yacht type mop head on the other.

Normally, cumbersome clamps have been used to clamp the string type mop heads to a connector which are bulky, complicated and relatively expensive inasmuch as they normally include several operating parts which can corrode or rust.

SUMMARY OF THE INVENTION

The present invention overcomes this principal disadvantage by providing a connector which is readily manufactured from synthetic plastic materials and which is extremely compact in configuration.

One aspect of the invention consists of a mop connector for a string type mop head having a central portion comprising in combination a handle receiving end and a mop receiving end, and means to secure the associated mop head into said mop head receiving end, said means including a flexible strap attached by one end thereof to one side of said mop head receiving end and adjustably secured in locking relationship to the other side of said mop head receiving end, said strap passing around the central portion of the associated mop head and holding same firmly within said mop head receiving end.

Another object of the invention is to provide a device of the character herewithin described in which a conventional handle is readily attachable to the other end of the connector, either by screw threading same or, alternatively, by rivetting same, depending upon design parameters.

A yet further object of the invention is to provide a device of the character herewithin described in which the attachment of the mop head to the connector comprises a rapid and simple operation.

Still another object of the invention is to provide a device of the character herewithin described in which the attaching strap is locked into position upon the connector when the mop head is installed thus preventing inadvertent disengagement of the mop head from the connector.

A still further object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

BRIEF DESCRIPTION OF THE DRAWINGS

FIG. 5 is a side elevation of the attaching strap.

FIG. 6 is a view similar to FIG. 5, but showing the strap in what may be termed the installed position.

FIG. 7 is a plan view of one side of the strap.

FIG. 8 is a view of the opposite side of the strap.

FIG. 9 is a fragmentary cross sectional view of FIG. 1 showing the mop head and strap installed.

In the drawings like characters of reference indicate corresponding parts in the different figures.

DETAILED DESCRIPTION

Figure 1:
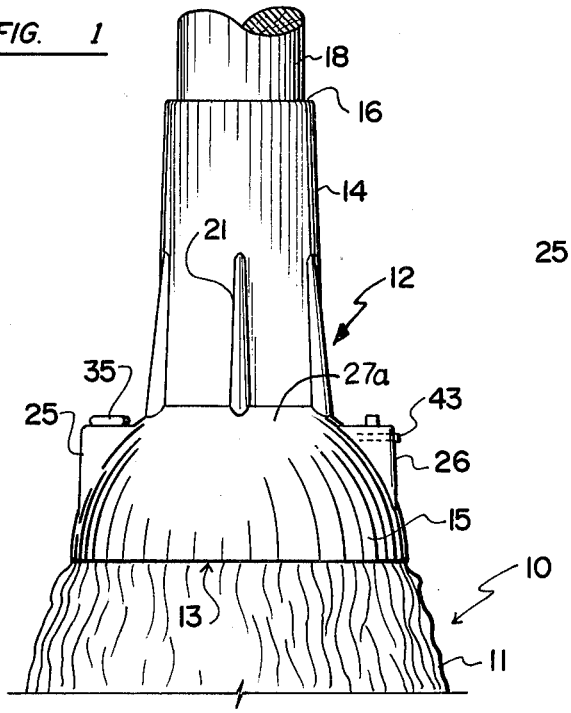
FIG. 1 is a fragmentary front elevation of the connector showing a portion of the handle and a mop head attached thereto.

Proceeding therefore to describe the invention in detail, reference character 10 illustrates a conventional string type mop head sometimes known as a yacht type mop head. It consists of a plurality of strands 11 of twisted material which are held centrally within a connector collectively designated 12 and the portion of the mop head held within the connector is designated by reference character 13 and constitutes a central section or portion.

The connector 12 is preferably made of synthetic plastic by injection moulding or the like and includes an upper substantially cylindrical portion 14 constituting a handle receiving portion, and a lower substantially dome-shaped portion 15 constituting a mop head receiving portion.

The upper portion 14 includes the smooth bored part 16 and a screw threaded lower part 17. A handle 18 is provided with a slightly reduced diameter screw threaded end 19 which screw threadably engages within the portion 17 thus drawing the part 20 of the handle downwardly into the smooth bored portion 16 thereby giving a firm attachment of the handle to the connector 12.

Figure 2:
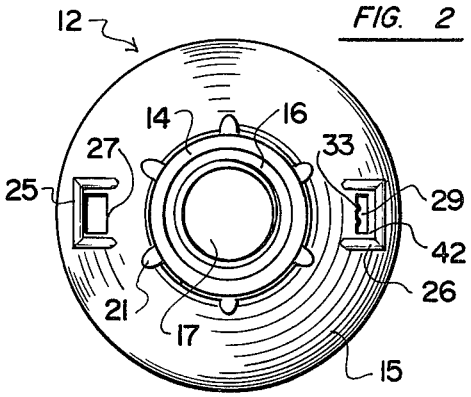
FIG. 2 is a top plan view of the connector per se.
Figure 3:
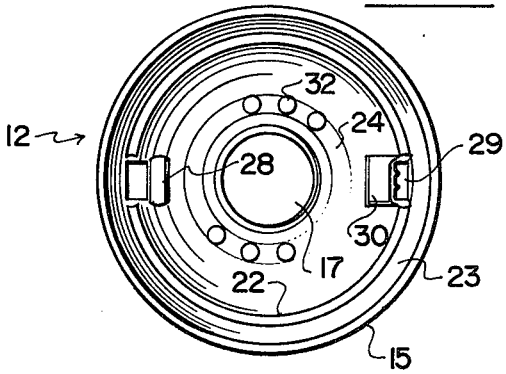
FIG. 3 is an underside view of the connector per se.

Strenghtening ribs 21 extend between the handle receiving portion 14 and the mop head receiving portion 15 on the outer surface thereof as clearly shown in FIGS. 1 and 2.

The interior of the dome-shaped mop head receiving portion 15 is provided with an annular shoulder 22 intermediate the open lower side 23 and the upper inner side or surface 24. A pair of diametrically opposite shoulders 25 and 26 are formed on the outer surface 27A of the dome-shaped portion 15 as illustrated in the drawings and an aperture 27 extends downwardly through the shoulder portion 25 to the interior of the dome-shaped portion and is bounded by a downwardly projecting reinforcing portion 28.

Figure 4:
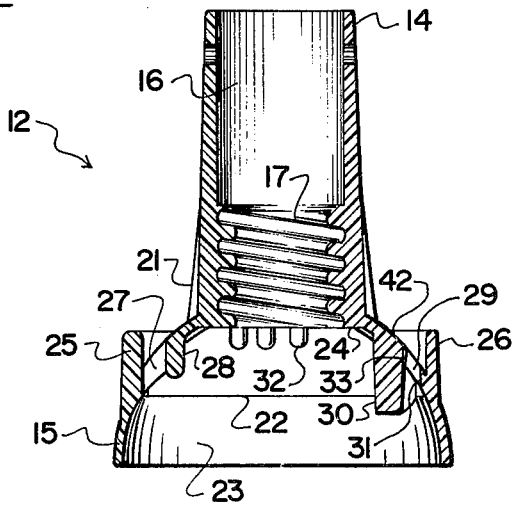
FIG. 4 is a sectional view of the connector per se.

The opposite shoulder 26 is provided with a relatively narrow slot 29 which extends downwardly into the interior of the dome-shaped portion and this is bounded by a larger reinforcing portion 30 which is spaced from the inner wall 31 as clearly shown in FIG. 4.

A plurality of mop head central portion engaging pins or projections 32 extend downwardly into the interior of the dome-shaped portion from the area surrounding the lower end of the screw threaded portion 17 of the handle receiving portion 14, the purpose of which will be hereinafter described.

Also to be noted is the provision of one or more relatively small vertically situated ribs 33 situated on the surface of the reinforcing part 30 bounding the slot 29.

An attaching strap collectively designated 34 is provided preferably manufactured from flexible synthetic plastic material. This strap which is an enlongated strip, is provided with a head 35 on one end thereof and a plurality of projecting pins 36 are provided on one surface 37 of the strap adjacent this headed end.

A plurality of ratchet teeth type projections 38 extend from the opposite side of the strap adjacent the distal end 40 thereof and these pins 36 and ratchet teeth type projections 38 are clearly shown in FIGS. 5 through 8.

The distal end 40 of the strap is passed downwardly through the aperture 27 from the outside of the connector with the pins 36 facing inwardly and the teeth 38 facing outwardly.

The central portion 13 of the associated mop head 10 is then placed across the open end 23 of the mop head receiving portion 15 of the connector whereupon the strap is passed around this central section and the distal end 40 is fed upwardly through the relatively narrow slot 29 as shown in FIG. 9.

It should be noted that the dimensions of slot 29 are just sufficient to take the distal end 40 of the strap 34 and further movement of the strap through slot 29 is restricted by the first ratchet tooth type projection specifically designated 38A.

An aperture 41 is provided adjacent the distal end 40 thus enabling a hooked tool (not illustrated) to be engaged therein or, alternatively, to enable this distal end of the strap to be attached to a fixed anchoring point (not illustrated).

Either method allows the strap to be forced through the slot 29, the resiliency of the teeth 38 allowing them to pass through the slot 29 and to snap outwardly once they are clear.

The strap is pulled tightly thus compressing the central portion 13 of the mop head and forcing same into engagement with the downwardly facing projection 32. The pins 36 also frictionally engage within the central sections so that when the strap is pulled as tightly as possible, the mop head is firmly clamped in position within the mop head receiving portion 15, it being observed that it is forced upwardly through the open end 23 to the position shown in FIG. 9.

At this point, one of the ratchet teeth specifically designated 38A engages the outer surface 42 of the shoulder 26 and prevents the strap from releasing. In other words, the strap is held in fixed locking relationship around the central section 13 of the mop head thus holding same firmly to the connector and preventing any inadvertent disengagement with the projections 32 and pins 36 preventing any relative movement of the mop head with the connector.

Finally, if desired, the end projecting above the shoulder 26 may be cut off and a staple or the like 43 engaged through the side of the connector, through the strap and into the reinforcing portion 30.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A mop connector for a string type mop head having a central portion comprising in combination a handle receiving end and a mop head receiving end, and means to secure the associated mop head into said mop head receiving end, said means including a flexible strap held by one end thereof to one side of said mop head receiving end and adjustably secured in locking relationship to the other side of said mop head receiving end, said strap passing around the central portion of the associated mop head and holding same firmly within said mop head receiving end and a slot formed through adjacent the upper side of said mop head receiving end and on the other side thereof, a plurality of ratchet teeth type projections formed on the outer side of said strap, said ratchet teeth type projections operatively engaging the boundary of said slot when said other end of said strap is pulled through said slot thereby locking said strap against disengagement from said slot, said mop head receiving end being substantially hollow dome-shaped, and means projecting downwardly from adjacent the upper inner surface of said mop head receiving end engageable within the central portion of said mop head to prevent relative movement between said mop head and said connector when said mop head is installed therein.

2. The connector according to claim 1 in which said strap includes mop head engaging pins extending from the inner side thereof engageable with the central portion of the mop head when installed, to frictionally engage said central portion.

3. The connector according to claim 1 which includes an aperture formed through said mop head receiving portion adjacent the upper side thereof and on said one side thereof, said strap engaging through said aperture, and means on one end of said strap restricting movement of said one end through said aperture.

4. The connector according to claim 2 which includes an aperture formed through said mop head receiving portion adjacent the upper side thereof and on said one side thereof, said strap engaging through said aperture, and means on one end of said strap restricting movement of said one end through said aperture.

* * * * *